US006679743B1

(12) United States Patent
Gerber

(10) Patent No.: US 6,679,743 B1
(45) Date of Patent: Jan. 20, 2004

(54) SAFETY THROW

(76) Inventor: Steven T. Gerber, 11318 Pine Orchard Cove, Fort Wayne, IN (US) 46845

( * ) Notice: Subject to any disclaimer, the term of this patent is extended or adjusted under 35 U.S.C. 154(b) by 0 days.

(21) Appl. No.: 10/310,413

(22) Filed: Dec. 5, 2002

(51) Int. Cl.[7] ..... B63C 9/26
(52) U.S. Cl. ..... 441/84; 441/80
(58) Field of Search ..... 441/84, 80, 85

(56) References Cited

U.S. PATENT DOCUMENTS 3,676,882 A * 7/1972 Lindqvist ..... 441/85
4,713,033 A * 12/1987 Cameron ..... 441/84
4,778,424 A * 10/1988 Lloyd ..... 441/85
6,257,942 B1 * 7/2001 Groover ..... 441/84

* cited by examiner

*Primary Examiner*—Jesus D. Sotelo
(74) *Attorney, Agent, or Firm*—Krieg DeVault Lundy LLP

(57) ABSTRACT

In the broader aspects of this invention there is provided a safety throw comprising a bag having a bottom with a bottom opening therein. A float is positioned in the bag. The float has an opening therein. A cord having opposite ends extends through the float and the float is positioned in the bag between the opposite ends to partition the bag into a first cord section and a second harness section. An over-the-shoulder harness is secured to the cord at one end. The harness is stored in the section adjacent the bag bottom and on the opposite side of the float from the cord section. The bag has a weight with the harness and float in the bag such that the bag may be thrown to a person in peril. The harness may be attached to the person in peril and the person in peril may be pulled to safety by the cord.

22 Claims, 2 Drawing Sheets

SAFETY THROW

BACKGROUND OF THE INVENTION

The present invention relates to a new and improved safety throw, and more particularly to a fully enclosed safety throw that is buoyant so as to float on water and has a harness for encapsulating a person in distress and a cord for pulling the person in the harness to safety.

Persons have long been rescued by safety throws of one kind or another. These include lifesavers aboard ships, throws with harness-like vests that can be placed on a person in distress and hauled to safety. Many such safety throws have been proposed in past years. However, each of these throws have disadvantages and while there are a multiplicity of throws available, they are generally selected for each purpose and no one throw is universally favored. Therefore, it is highly desirable to provide a new and improved universally favorable safety throw.

Favorable safety throws have a number of common properties. First, any safety throw for water rescue must float. A safety throw that is thrown to a person in peril in the water cannot easily be grasped by the person if the throw sinks and the throw will not assist the person in staying afloat. Thus, it is highly desirable to provide a new and improved universally favorable safety throw that floats when thrown into the water.

Favorable safety throws must be able to be thrown a significant distance. This means that the weight and size of the throw must be such that a person can throw the safety throw a significant distance. Further, the weight of the throw must be sufficient such that the momentum of the thrown safety throw is capable of training out from a coil or out from a storage container sufficient cord attached to the throw such that the throw, once grasped by a person in peril, is capable of pulling the distressed person to safety by the cord. This usually means that a suitable throw weight to cord weight ratio must be maintained and the length of the cord must be at least 50 feet. It is therefore highly desirable to provide a new and improved universally favorable safety throw having a cord weight to throw weight ratio of above about 1.5 and a cord of at least 50 feet in length.

Favorable throws also have a convenient package for transporting the throw when not in use. Prior art lifesavers aboard ships are hung on the side of the ship with a visible coil of cord adjacent thereto. To transport the same, both the large coil of cord and the lifesaver itself must be transported, both of which are extremely bulky. Thus, it is highly desirable to provide a new and improved universally favorable safety throw that is easily packaged and transported. It is also highly desirable to provide a new and improved universally favorable safety throw that is small in size, lightweight and in a package that can easily be transported.

In cold weather, a person in perilous waters may be suffering from hypothermia. Persons suffering from hypothermia usually cannot grasp any kind of a life saving deice or cord. Thus, it is highly desirable to provide a new and improved universally acceptable harness on a safety throw that can be utilized by persons in distress whether or not suffering from hypothermia.

What makes a safety throw usable for particular instances is the type of harness the safety throw has, the length of cord available, and the ability to place the throw near the person in distress. For most universal situations, cords of about 50 feet in length will handle most situations. It is therefore highly desirable to provide a new and improved universally favorable safety throw having a cord of at least 50 feet in length.

Finally, a preferred throw when packaged and carried should be aesthetic to the eye and easily transported. Therefore, it is highly desirable to provide a new and improved universally favorable safety throw having a harness and a cord all of which can be stored in a duffel bag of designer coloring and fabrics having a belt loop or the like such that it can be easily carried on all camping and hiking and over the water expeditions.

Finally, it is highly desirable to provide a new and improved universally favorable safety throw having all of these features.

SUMMARY OF THE INVENTION

It is an object of the invention to provide a new and improved universally favorable safety throw.

It is also an object of the invention to provide a new and improved universally favorable safety throw that floats when thrown into the water.

It is also an object of the invention to provide a new and improved universally favorable safety throw having a cord weight to throw weight ratio of above about 1.5 and a cord of at least 50 feet in length.

It is also an object of the invention to provide a new and improved universally favorable safety throw that is easily packaged and transported.

It is also an object of the invention to provide a new and improved universally favorable safety throw that is small in size, lightweight and in a package that can easily be transported.

It is also an object of the invention to provide a new and improved universally acceptable harness on a safety throw that can be utilized by persons in distress whether or not suffering from hypothermia.

It is also an object of the invention to provide a new and improved universally favorable safety throw having an over-the-shoulder harness and a cord of at least 50 feet in length.

It is also an object of the invention to provide a new and improved universally favorable safety throw having a harness and a cord all of which can be stored in a duffel bag of designer coloring and fabrics having a belt loop or the like such that it can be easily carried on all camping and hiking and over the water expeditions.

Finally, it is an object of the invention to provide a new and improved universally favorable safety throw having all of these features.

In the broader aspects of this invention there is provided a safety throw comprising a bag having a bottom with a bottom opening therein. A float is positioned in the bag. The float has an opening therein. A cord having opposite ends extends through the float and the float is positioned in the bag between the opposite ends to partition the bag into a first cord section and a second harness section. An over-the-shoulder harness is secured to the cord at one end. The harness is stored in the section adjacent the bag bottom and on the opposite side of the float from the cord section. The bag has a weight with the harness and float in the bag such that the bag may be thrown to a person in peril. The harness may be attached to the person in peril and the person in peril may be pulled to safety by the cord.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
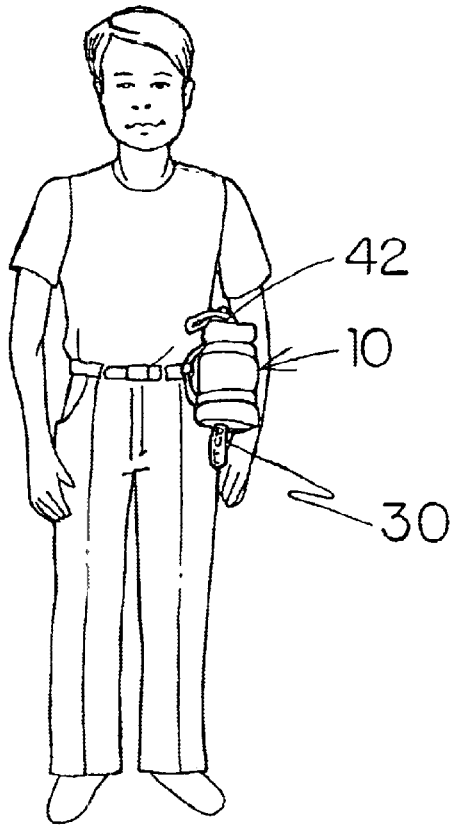
FIG. 1 is a perspective view of a person having the new and improved safety throw of the invention on his belt by means of the belt loop provided.

The new and improved safety throw of the invention comprises a bag 10 having a bottom 12 and upstanding sides 14. Upstanding sides 14 define at the end opposite bottom 12 an entrance opening 16 that provides access to the interior of the bag 10. Entrance opening 16 is closed by a drawstring 18 on which a lock 20 is positioned. Drawstring 18 is made operational by providing a hem 22 through which the drawstring 18 is threaded. Bag 10 is also provided with a loop 24 having opposite ends that are secured to the bag adjacent bottom 12 and opening 16. Loop 24 may, in the middle between opposite ends 26, have a buckle 28 if desired. Stored within the bag 10 is a harness 30, a float 32 and a cord 34. Cord 34 has opposite ends 36, 38. As shown in the drawings at each end is a bow line 40. Each bow line 40 comprises a loop 42 and a bow line knot 44.

In a specific embodiment, bag 10 is constructed like a miniature duffel bag. Thus, bag 10 has a uniform size between the bottom 12 and the top opening 16. Bag 10 also has cross-sections taken parallel to the bottom that are generally circular. In a specific embodiment, float 32 is a disc-shaped piece of relatively durable, buoyant material of the same or slightly smaller diameter as the bag 10. Float 32 has an opening 35 therein through which the cord 34 is trained. Float 32 has a diameter which is the approximate diameter of the bag 10 and is positioned in the bag 10 and functions as a partition. On one side of the partition is harness storage 46 adjacent bottom 12, and on the other side of float 32 is cord storage 48 adjacent opening 16. Float 32 thus prevents the harness 30 and the cord 34 from tangling.

In a specific embodiment, loops 42 do not have to be part of a bow line, but may merely be loops 42 to which the distal ends 36, 38 of the cord 34 are looped around and secured. In a specific embodiment, float 32 may be disc-shaped having essentially the diameter of the bag 10. However, other shapes of float 32 may also be utilized. In all embodiments of the invention, float 32 acts as a partition to segregate the harness storage 46 from the cord storage 48. In a specific embodiment, the float 32 has an opening 35 through which the cord 34 passes. The float 32 is maintained on the cord 34 by a knot 50 in the cord on opposite sides of the float. In another specific embodiment, knot 50 adjacent bottom 12 could be the bow line knot 44.

In a specific embodiment, float 32 may be a block of closed cell synthetic buoyant material. In other specific embodiments, the float 32 may be a block of wood, or a hollow block of material. In another specific embodiment, cord 50 may be of synthetic or naturally occurring materials chosen from the group of cord materials including polypropylene, polyethylene, hemp and combinations of the same.

Harness 30, in a specific embodiment, may be either cord or belt material. Harness 30, in a specific embodiment, is a belt 52 of woven synthetic belting material including polypropylene, polyethylene and combinations thereof. Harness 30 is a length of belt formed into a loop. Harness 30 is threaded through an opening 54 in bottom 12 and threaded through the bow line loop 42 adjacent bottom 12 and stitched to the bottom 12 by stitching 62. The stitching of the harness 30 to the bottom 12 maintains the bow line 40 adjacent bottom 12, and thus maintains the float 32 adjacent bottom 12. Float 32 is maintained on cord 34 by knots 44, 50 as above described.

Figure 3:
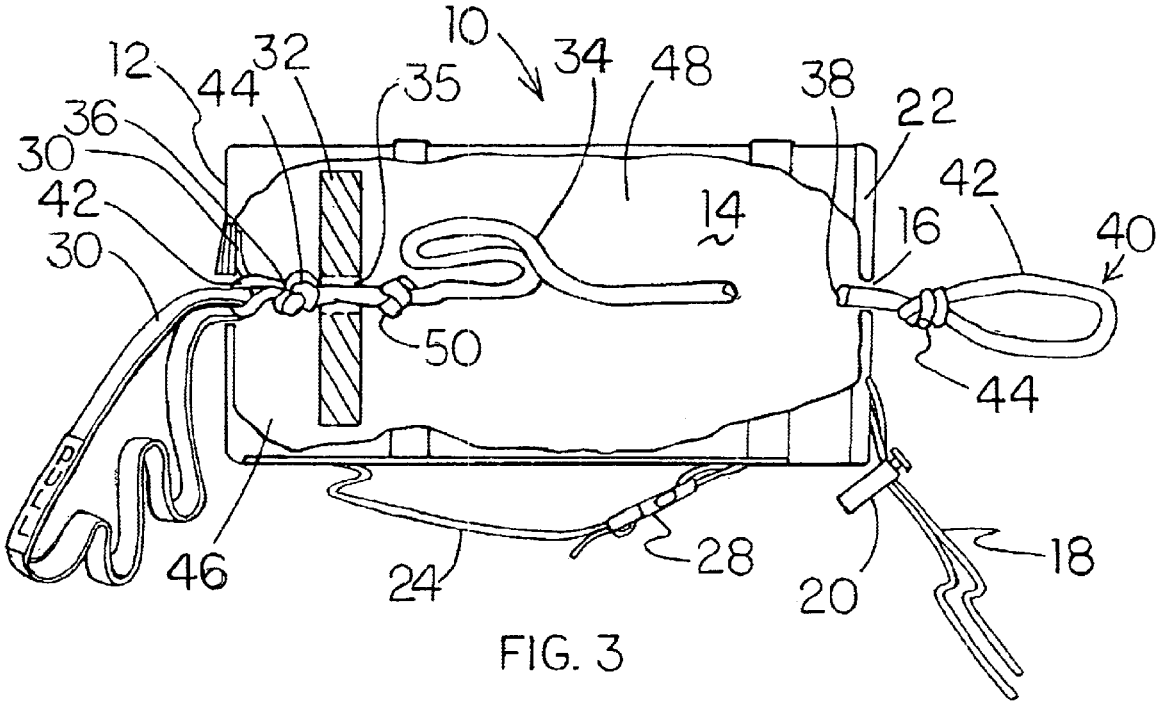
FIG. 3 is a side view with the bag broken away showing all of the structure of the new and improved safety throw of the invention.

As shown in FIG. 1, a rescuer may carry the new and improved safety throw on his person as he conducts his duty as a policeman, fireman, conservation officer, ranger or the like. In this particular instance, the new and improved safety throw is shown on a person's belt with the person's belt threaded through the loop 24 of the bag 10. As shown in FIG. 3, both the harness 30 and the cord 34 may be stored in the bag 10. The harness 30 is stored in the bag 10 between the float 32 and the bottom 12 of bag 10 with a portion of the harness 32 extending from the bottom opening 54. Similarly, the cord 34 is coiled within the bag 10 or laid in the bag 10 in an orderly fashion between the float 32 and the bag opening 16. In a specific embodiment in which the opening 16 is provided with a drawstring, the bag may be maintained in a closed position by the drawstring being pulled and the lock 20 being moved into a suitable locking position. When the bag is fully loaded, both the harness 30 and the bow line loop 42 adjacent end 38 of the cord 34 may both be totally within the bag 10. Alternatively, a small portion of the harness 30 may extend through the bottom opening 54. Similarly, a small portion of the bow line loop 42 may extend from the bag 10 through opening 16.

In a specific embodiment, the bag weighs approximately 1.5 pounds when full of cord 34. When the cord 34 is fully pulled from the bag 10, the bag weighs approximately 8.5 ounces. This weight is sufficient to throw the bag approximately 50 feet and to allow the cord to train out of opening 16 whether fully opened or partially closed around the rope by the drawstring 18 and lock 20. In a specific embodiment, the shoulder harness is approximately four feet to approximately seven feet long and the bow line loops 42 are approximately eight inches in circumference. In a specific embodiment, the float is a disk having a thickness of approximately 0.75 inches and a diameter of approximately four inches and the bag 10 has a circular bottom and a uniform diametral size from end 36 to end 38 of approximately five inches in diameter and an axial length of approximately one foot.

Figure 2:
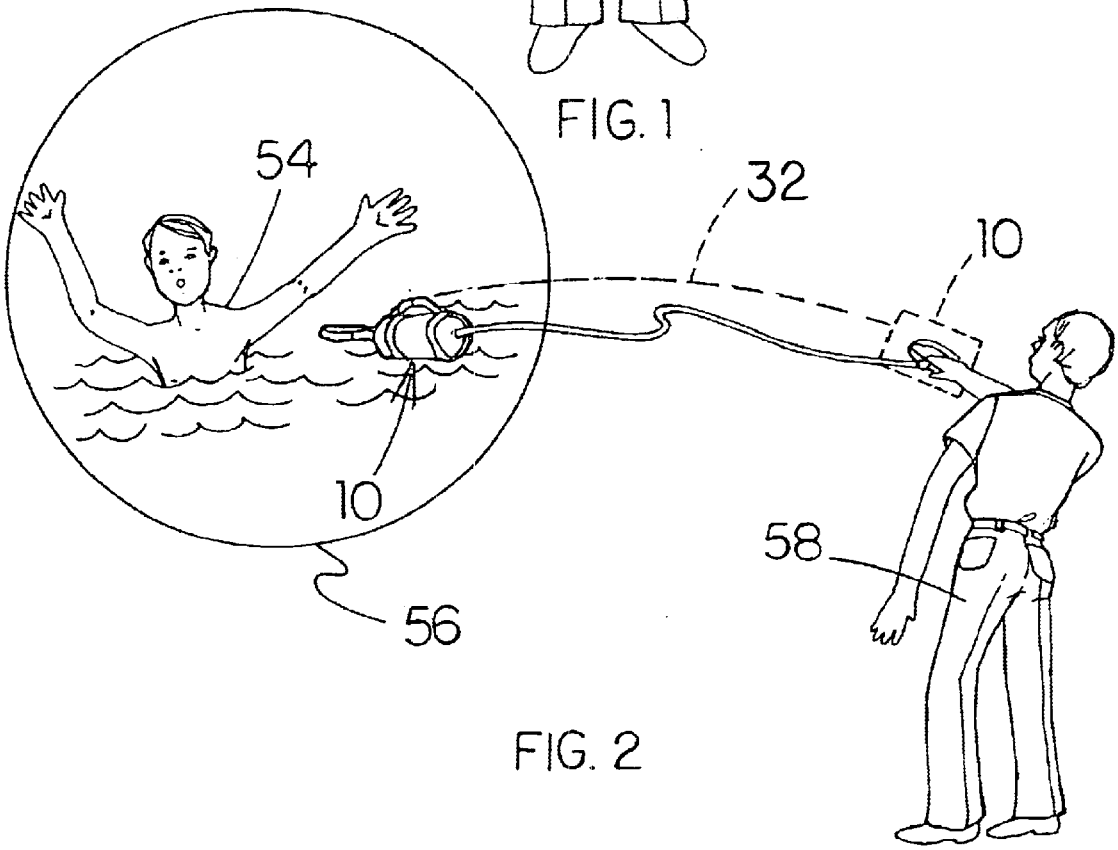
FIG. 2 is a perspective view of a rescue scene in which the person throws the new and improved safety throw of the invention to the person in distress while hanging onto the distal end of the cord. The safety throw lands adjacent the person in stress floating next to the person; once the person in distress places the harness of the safety throw over the shoulders and under the arms, the person may be hauled to safety by means of the cord.

In operation, the new and improved safety throw of the invention is used to save lives. A rescue person can be approximately 50 feet from a person in distress and be saved by the new and improved throw of the invention. In such a case, the rescue person merely grasps on to the bow line loop 42 at end 38 of the cord 32 and throws the bag 10 toward the person in distress. When the bag 10 lands adjacent to the person in distress, the person in distress merely grabs on to the harness 30 and pulls the harness 30 from the bag 10 and drops the harness 30 over their shoulders and positions the harness 30 under their arms. Even a person in distress suffering from hypothermia can engage harness 30 because of its unique design. In this position the rescue person may pull the distressed person into safety by pulling on the cord 34. Such a rescue is illustrated in FIG. 2 in which the distressed person 54 is in water 56, the bag 10 is thrown by the rescue person 58 to land next to the distressed person 54. Once the person 54 places the harness 30 over his/her shoulders and under his/her arms, the rescue person can pull on the cord 34 and pull the distressed person 54 to safety.

While a specific embodiment of the invention has been shown and described herein for purposes of illustration, the protection afforded by any patent which may issue upon this application is not strictly limited to the disclosed embodiment; but rather extends to all structures and arrangement which fall fairly within the scope of the claims which are appended hereto:

What is claimed is:

1. A safety throw comprising a bag having a bottom with a bottom opening therein, a float positioned in said bag, said float having an opening therein, a cord having opposite ends extending through said float, a harness secured to one of said opposite cord ends, said harness and cord being storable in said bag on opposite sides of said float, both said harness and said cord being trainable out of said bag as needed, whereby said bag may be thrown to a person in peril, said harness may be attached to said person and said person hauled to safety by said cord.

2. The safety throw of claim 1 wherein said bag has walls upstanding from said bottom, said walls defining a top opening.

3. The safety throw of claim 2 wherein said top opening is closed around said cord by a frictionless opening closure.

4. The safety throw of claim 3 wherein said frictionless opening closure is a drawstring.

5. The safety throw of claim 4 wherein said drawstring has an adjustable lock thereon.

6. The safety throw of claim 1 wherein said cord is a flexible and coilable woven rope chosen from the group of flexible and coilable woven ropes consisting of polyethylene ropes, polypropylene ropes, hemp ropes and combinations thereof.

7. The safety throw of claim 1 wherein said float has sufficient buoyancy to keep said bag full of said cord and said harness afloat.

8. The safety throw of claim 1 wherein said float is disc-shaped.

9. The safety throw of claim 1 wherein said float has a size and shape transversely of said cord geometrically similar to the cross-section of said bag thereby keeping said bag in an expanded condition.

10. The safety throw of claim 1 wherein said float partitions said bag into a harness section adjacent to said bottom and a cord section adjacent to said top, said float keeps said cord and harness from tangling.

11. The safety throw of claim 1 wherein said harness is secured to said bag adjacent said bottom opening.

12. The safety throw of claim 1 wherein said float is located on said cord by having a knot in said cord on opposite sides of said float.

13. The safety throw of claim 1 wherein said cord has a loop at said other end.

14. The safety throw of claim 1 wherein said cord has a loop at said one end, said harness being threaded through said loop.

15. The safety throw of claim 1 wherein said cord has a bow line at said one end and said harness is threaded through said bow line.

16. The safety throw of claim 1 wherein said cord has a bow line at said other end.

17. The safety throw of claim 1 wherein said bag has circular cross-sections taken parallel to said bottom.

18. The safety throw of claim 17 wherein said float diameter and said bag diameter are approximately the same.

19. The safety throw of claim 1 wherein said harness is a loop of belting.

20. The safety throw of claim 19 wherein said belting is of synthetic material.

21. The safety throw of claim 19 wherein said belting is chosen from the group of synthetic materials consisting of polypropylene, polyethylene, and combinations thereof.

22. The safety throw of claim 1 wherein said harness is an over-the-shoulder harness to be positioned under the arms of a distressed person.

* * * * *